US012018680B2

(12) United States Patent
Moreno et al.

(10) Patent No.: US 12,018,680 B2
(45) Date of Patent: Jun. 25, 2024

(54) FLUID PUMP WITH THRUST BEARING DRIVER

(71) Applicant: DELPHI TECHNOLOGIES IP LIMITED, St. Michael (BB)

(72) Inventors: Alejandro Moreno, El Paso, TX (US); Aldo Darien Venegas Carrillo, Ciudad Juarez (MX)

(73) Assignee: PHINIA Delphi Luxembourg SARL, Belvaux (LU)

( * ) Notice: Subject to any disclaimer, the term of this patent is extended or adjusted under 35 U.S.C. 154(b) by 190 days.

(21) Appl. No.: 17/718,815

(22) Filed: Apr. 12, 2022

(65) Prior Publication Data

US 2023/0323874 A1 Oct. 12, 2023

(51) Int. Cl.
*F04C 15/00* (2006.01)
*F04C 2/10* (2006.01)

(52) U.S. Cl.
CPC ..... *F04C 15/0073* (2013.01); *F04C 2/10* (2013.01); *F04C 15/0076* (2013.01); *F04C 2240/30* (2013.01); *F04C 2240/40* (2013.01); *F04C 2240/50* (2013.01)

(58) Field of Classification Search
CPC .... F04C 15/0073; F04C 2/10; F04C 15/0076; F04C 2240/30; F04C 2240/40; F04C 2240/50; F04C 2/102; F04C 15/0057; F04C 29/041; F04D 29/046; F04D 29/20; F04D 29/263; F04D 29/266
See application file for complete search history.

(56) References Cited

U.S. PATENT DOCUMENTS 1,220,483 A 3/1917 Williams et al.
2,484,789 A * 10/1949 Hill ..... F04C 14/185 74/462
3,240,350 A 3/1966 Petersen
(Continued)

FOREIGN PATENT DOCUMENTS

DE 202009009158 U1 9/2009
DE 102009034643 B4 9/2011
(Continued)

OTHER PUBLICATIONS

Extended European Search Report, dated Sep. 4, 2023, issued by the European Patent Office in application No. 23167148.

*Primary Examiner* — Bryan M Lettman
(74) *Attorney, Agent, or Firm* — Warner Norcross + Judd LLP

(57) ABSTRACT

A fluid pump includes an inlet plate and an electric motor. The electric motor has a shaft that rotates about an axis. A pumping arrangement is rotationally coupled to the shaft. The pumping arrangement includes an rotating element. The fluid pump further includes a thrust bearing driver including a disc-like plate having first and second faces, and two posts extending perpendicularly from the first face. The shaft has a terminal end including a pair of slots that cooperate with the posts of the thrust bearing driver. The inner gear rotor has an inner surface including a pair of slots that cooperate with the posts of the thrust bearing driver. The posts of the thrust bearing driver are received in the slots of both the shaft and the rotating element, and the thrust bearing driver is sandwiched between the shaft, the inlet plate, and the rotating element.

17 Claims, 9 Drawing Sheets

(56) References Cited

U.S. PATENT DOCUMENTS 3,881,849 A * 5/1975 Commarmot ..... F04C 2/084 415/217.1
4,311,028 A 1/1982 Brown et al.
4,361,419 A * 11/1982 Vohringer ..... F04C 2/102 418/73
4,573,882 A * 3/1986 Watanabe ..... F02M 37/08 415/55.1
4,958,984 A * 9/1990 Aoi ..... F04D 29/20 415/55.1
5,006,048 A * 4/1991 Jow ..... F04C 15/0061 417/366
5,393,203 A * 2/1995 Hantle ..... F02M 37/18 417/205
6,106,240 A * 8/2000 Fischer ..... F04C 15/06 417/423.6
9,835,152 B2 * 12/2017 Sakai ..... F02M 37/045
10,330,108 B2 6/2019 Volker et al.
10,393,077 B2 8/2019 Furuhashi et al.
10,851,778 B2 * 12/2020 Furuhashi ..... F04C 15/00
10,883,499 B2 1/2021 Sakai et al.
10,934,985 B2 * 3/2021 Sakai ..... F04C 11/008
2007/0292268 A1 * 12/2007 Nishiyama ..... F04D 29/266 415/230
2008/0112821 A1 * 5/2008 Morris ..... F04C 2/3445 417/273
2012/0051954 A1 3/2012 Asai et al.
2013/0052057 A1 * 2/2013 Huser ..... F04C 29/0071 417/410.3
2014/0241861 A1 8/2014 Moss et al.
2016/0245284 A1 * 8/2016 Moreno ..... F04C 2/103
2016/0298625 A1 * 10/2016 Sakai ..... F04C 2/102
2016/0305425 A1 10/2016 Sakai et al.
2016/0305426 A1 * 10/2016 Sakai ..... F04C 11/008
2016/0333875 A1 * 11/2016 Sakai ..... F02M 59/14
2016/0333878 A1 * 11/2016 Sakai ..... F04C 15/0061
2018/0010606 A1 * 1/2018 Sakai ..... F04C 15/0061
2018/0087504 A1 * 3/2018 Sakai ..... F04C 11/008
2018/0112659 A1 * 4/2018 Sakai ..... F04C 15/06
2018/0258929 A1 * 9/2018 Fischer ..... F04C 15/06
2018/0306148 A1 * 10/2018 Sakai ..... F04C 15/06
2018/0347526 A1 * 12/2018 Ito ..... F04C 2/102
2019/0128207 A1 5/2019 Blackman et al.
2022/0196014 A1 * 6/2022 Bruemmer ..... F04C 29/0071

FOREIGN PATENT DOCUMENTS

JP H06123288 A 5/1994
JP H1113640 A 1/1999

* cited by examiner

FLUID PUMP WITH THRUST BEARING DRIVER

FIELD OF THE INVENTION

The disclosure generally relates to a fluid pump that pumps fluid and, more specifically, to a fuel pump that pumps fuel, particularly a fuel pump having an improved drive shaft to gear coupling.

BACKGROUND OF THE INVENTION

Fluid pumps, and more particularly fuel pumps for pumping fuel, for example, from a fuel tank of a motor vehicle to an internal combustion engine of the motor vehicle, are known. A typical fuel pump includes a housing within which generally includes a pump section, a motor section, and an outlet section. The pump section includes an inlet plate, an outlet plate, and a pumping arrangement between the inlet plate and the outlet plate. The pumping arrangement is rotated by an electric motor located in the motor section, thereby causing fuel to be drawn into the housing through an inlet of the inlet plate and through an outlet passage of the outlet plate. The fuel then passes the electric motor and exits the housing through an outlet of the outlet section. The fuel pump may be an impeller type fuel pump where the pumping arrangement is an impeller or the fuel pump may be a gerotor-type fuel pump where the pumping arrangement is an inner gear rotor surrounded by an outer gear rotor. Alternatively, the fuel pump may be a vane-type fuel pump, a gear-type fuel pump, or a roller vane-type fuel pump.

Electronic fuel pumps ("EFP's") used in vehicles were conventionally DC "brush" motor pumps. These DC pumps were driven by a constant voltage signal and were turned on and off in connection with the ignition switch of the vehicle, i.e. when the ignition switch was turned on, the DC pump was turned on, and when the ignition switch was turned off, the DC pump was turned off. As the demand for improved vehicle fuel economy has increased in the automotive industry, the need to regulate the flow and/or pressure provided by electronic fuel pumps has arisen. Such regulation requires a more robust pump design and sophisticated Fuel Pump Controllers ("FPC's"). Current fuel delivery modules ("FDM's") use electronic commutated ("EC") "brushless" pumps or DC pumps with special FPC's to feed fuel in "start-stop" and closed loop pressure control ("CLPC") fuel delivery systems designed to increase overall fuel system efficiency and pressure/flow control. One of the trade-offs of using an EFP with variable pressure/flow control is the increased wear and tear on the pump components, due to the increase in on-off and speed change cycles the EFP needs to withstand.

For example, the main considerations in designing the motor armature/rotor shaft to gear coupling interface to transmit both radial and axial loads in an EFP include strength, fatigue life, wear resistance, noise, and longevity (i.e., ability to maintain function without premature failure). As the required pressure levels and duty cycles for EFP's has increased, it has become more difficult to maintain a balance between cost, size, and function. One approach to transferring torque between the motor shaft and the rotating member of the pump section is a steel shaft engaged to a steel rotor interface. However, this type of interface is noisy and prone to fretting wear failures in low-lubricity fuel. The axial position of the motor shaft and resultant axial loads from the motor to the pump shaft may also be controlled by use of a collar or thrust pad. Inserting a plastic member between the shaft and pump section rotor can help alleviate the mechanical noise concerns, but use of a plastic member raises other mechanical issues not present in the metal-to-metal design. Specifically, this configuration uses a separate plastic molded component to couple the shaft to the inner gear. The plastic member reduces noise and the low-lubricity wear issues related to the metal-to-metal interfaces, but is not as strong and is more susceptible to fracturing or mechanical failure under high cyclic loading because of the weaker properties of the plastic material.

A need exists for a more robust drive shaft to gear coupling in an electronic fuel pump that alleviates one or more of these shortcomings.

BRIEF SUMMARY

An improved fluid pump for a vehicle fuel delivery module is provided. In specific embodiments, the fluid pump includes a housing and an inlet plate disposed within the housing. The inlet plate has an inlet which introduces fluid to the housing. An outlet plate is disposed within the housing. The outlet plate has an outlet passage. The fluid pump also includes an outlet which discharges fluid from the housing. The inlet, outlet passage, and outlet are in fluid communication with each other. An electric motor is disposed with the housing between the outlet plate and the outlet. The electric motor has a shaft that rotates about an axis. A pumping arrangement is rotationally coupled to the shaft such that rotation of the pumping arrangement by the shaft causes fluid to be pumped from the inlet to the outlet passage and through the outlet. The pumping arrangement is located axially between the inlet plate and the outlet plate, and the pumping arrangement includes a rotating element. The fluid pump further includes a thrust bearing driver including a disc-like plate having first and second faces, and two posts extending perpendicularly from the first face. The shaft has a terminal end including a pair of slots that cooperate with the posts of the thrust bearing driver. The rotating element has an inner surface including a pair of slots that cooperate with the posts of the thrust bearing driver. The posts of the thrust bearing driver are received in the slots of both the shaft and the rotating element, and the thrust bearing driver is sandwiched between the shaft, the inlet plate, and the rotating element.

In particular embodiments, the posts of the thrust bearing driver have a polygonal or a circular cross-sectional shape.

In specific embodiments, the slots of the shaft and the rotating element have a shape that complements the cross-sectional shape of the posts of the thrust bearing driver.

In particular embodiments, the posts of the thrust bearing driver have an outer portion that includes a rounded surface and an inner portion that includes a flat surface.

In specific embodiments, the slots of the shaft have a shape that complements the flat surface of the posts of the thrust bearing driver, and the slots of the rotating element have a shape that complements the rounded surface of the posts of the thrust bearing driver.

In particular embodiments, the posts of the thrust bearing driver are symmetrically arranged on the first face of the plate.

In particular embodiments, the posts of the thrust bearing driver are arranged proximate an outer edge of the plate.

In particular embodiments, the terminal end of the shaft engages the first face of the plate.

In particular embodiments, the second face of the plate engages a surface of the inlet plate.

In particular embodiments, the slots of the thrust bearing driver mate with the slots of the shaft and the slots of the rotating element to couple the shaft to the rotating element.

In particular embodiments, the thrust bearing driver is sandwiched between the shaft and the inlet plate in an axial direction, and the thrust bearing driver is sandwiched between the shaft and the rotating element in a radial direction.

In specific embodiments, the rotating element is an inner gear rotor that together with an outer gear rotor form the pumping arrangement.

DESCRIPTION OF THE DRAWINGS

Various advantages and aspects of this disclosure may be understood in view of the following detailed description when considered in connection with the accompanying drawings, wherein.

DETAILED DESCRIPTION OF THE INVENTION

A fluid pump is provided. Referring to FIGS. 1-6, wherein like numerals indicate corresponding parts throughout the several views, the fluid pump is illustrated and generally designated as a fuel pump 10 for pumping liquid fuel, by way of non-limiting example only gasoline or diesel fuel, from a fuel tank (not shown) to an internal combustion engine (not shown). While the fluid pump is illustrated as fuel pump 10, it should be understood that the invention is not to be limited to a fuel pump, but could also be applied to fluid pumps for pumping fluids other than fuel. The fuel pump 10 includes a thrust bearing driver that provides for one or more of improved durability, reduced noise, torque transfer between the motor drive shaft and the pump gears, and angular and radial self-alignment of the drive shaft, pump inner gear, and pump inlet plate. Certain features of the fuel pump 10 are functional, but can be implemented in different aesthetic configurations.

Figure 1:
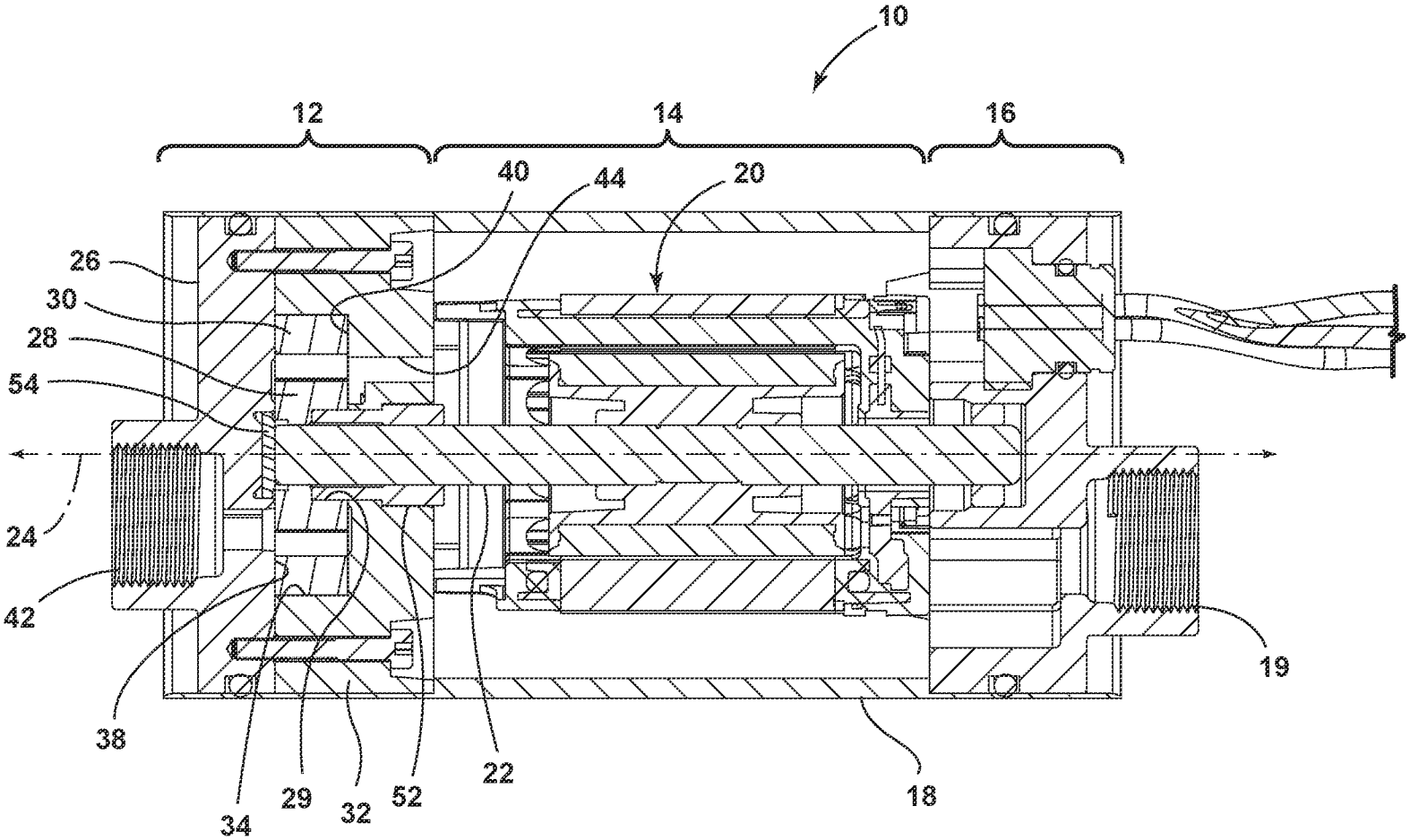
FIG. 1 is an axial cross-sectional view of a fluid pump in accordance with some embodiments of the disclosure.
Figure 2:
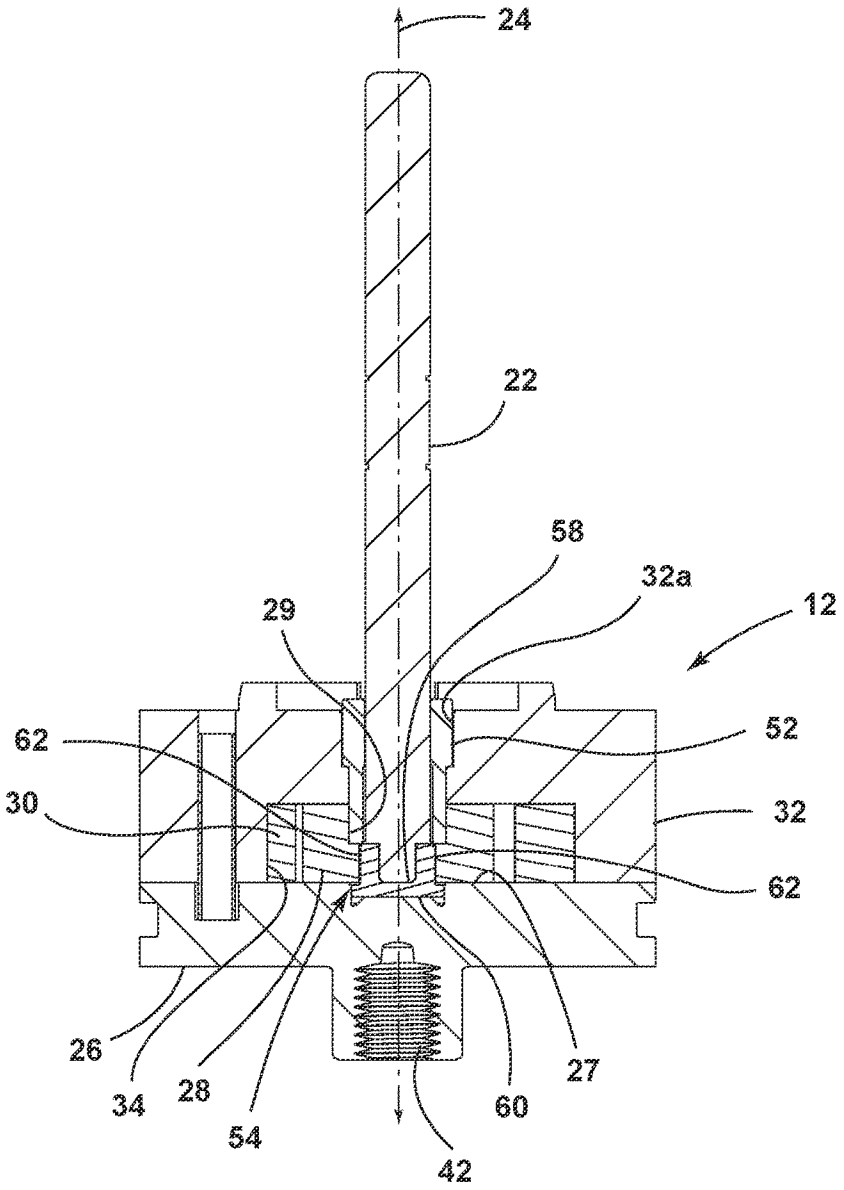
FIG. 2 is an axial cross-sectional view of a pumping section of the fluid pump of FIG. 1.
Figure 3:
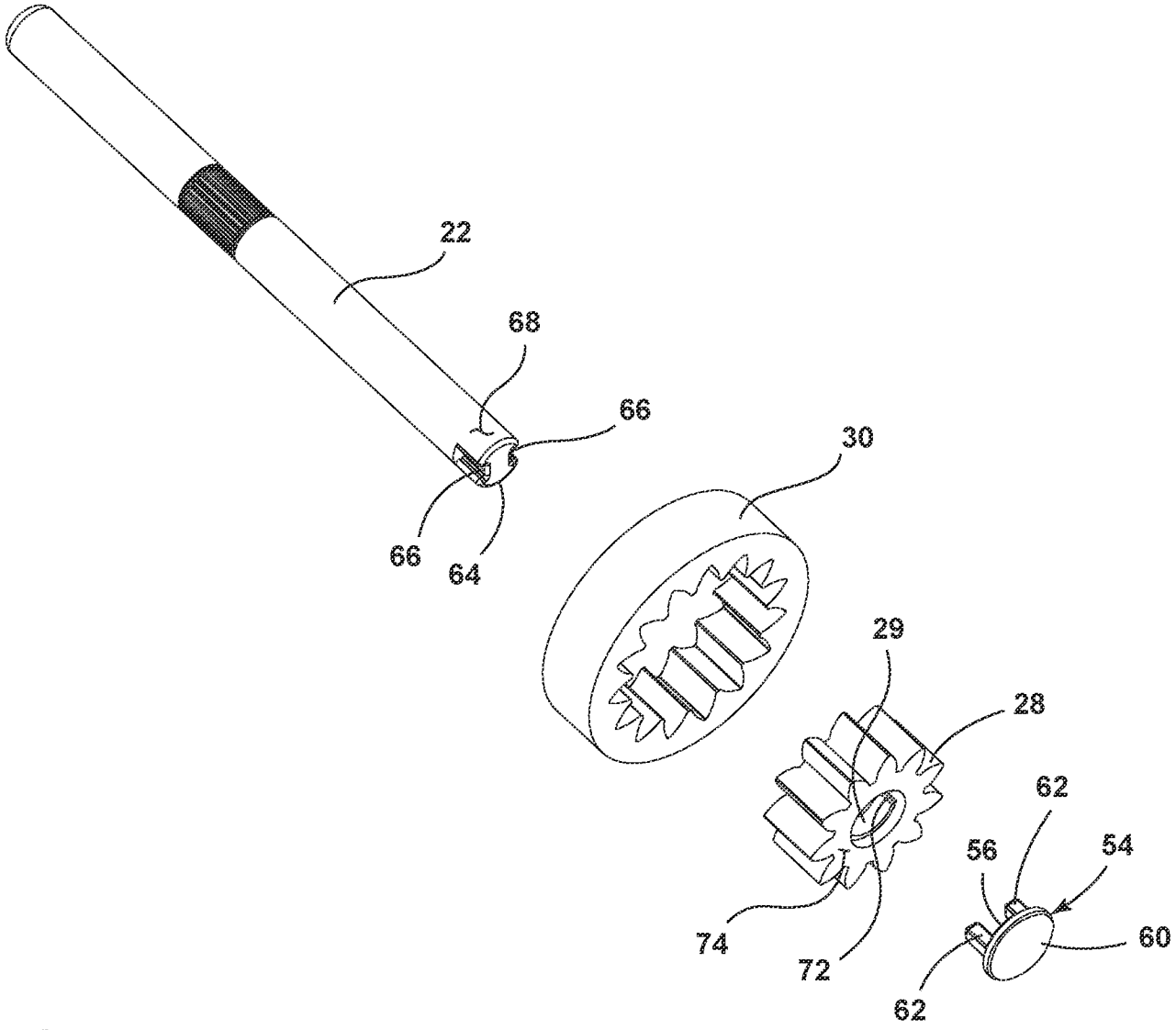
FIG. 3 is an exploded view of an internal portion of the pumping section of FIG. 2.
Figure 4:
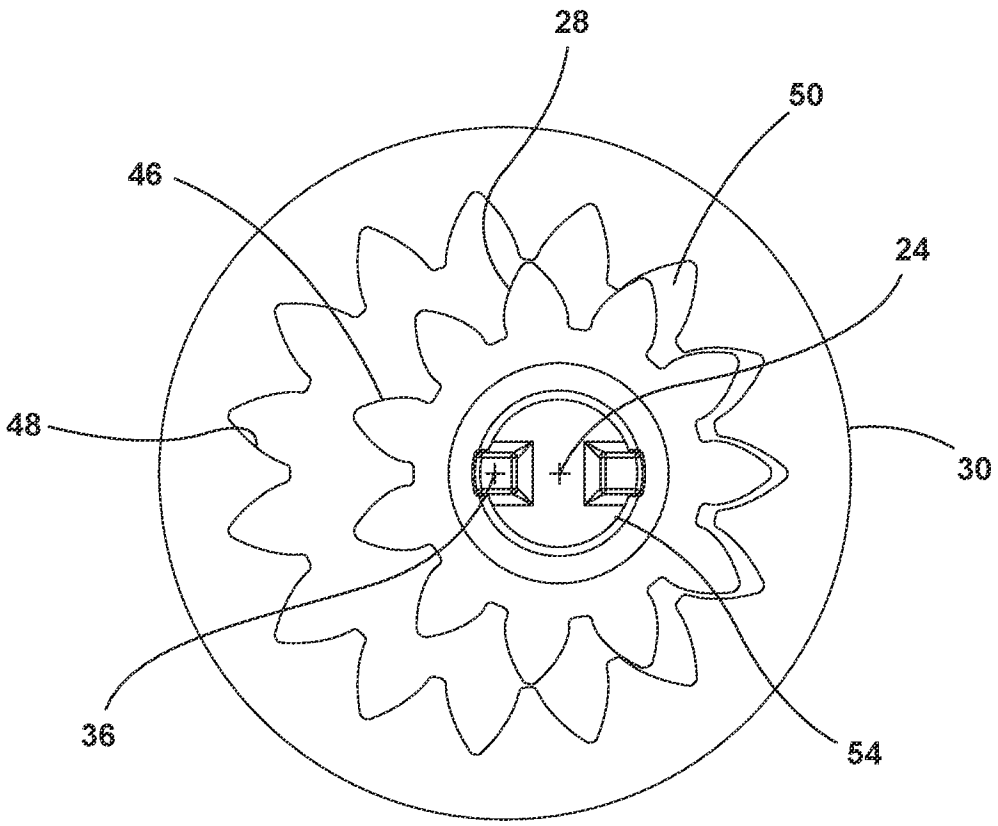
FIG. 4 is a plan view of an inner gear rotor, an outer gear rotor, and a thrust bearing driver of the internal portion of the pumping section of FIG. 3.
Figure 5:
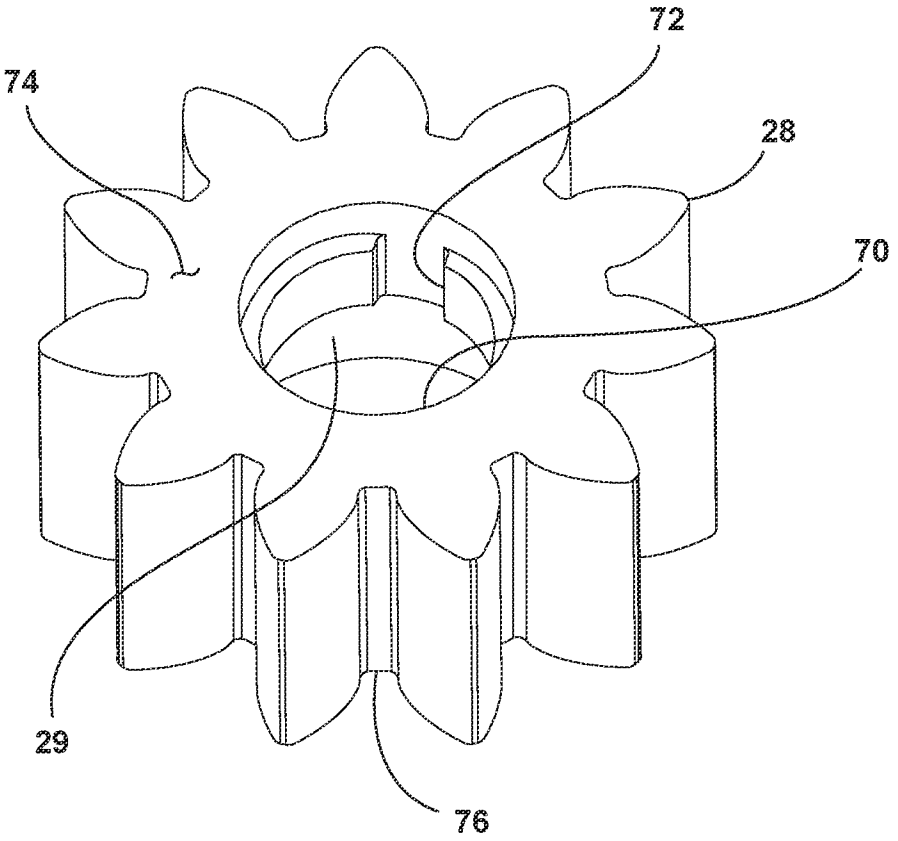
FIG. 5 is a perspective view of the inner gear rotor of the internal portion of the pumping section of FIG. 3.

With reference to FIG. 1, fuel pump 10 generally includes a pump section 12 at one end, a motor section 14 adjacent to pump section 12, and an outlet section 16 adjacent to motor section 14 at the end of fuel pump 10 opposite pump section 12. A housing 18 of fuel pump 10 retains pump section 12, motor section 14 and outlet section 16 together. Fuel enters fuel pump 10 at pump section 12, a portion of which is rotated by motor section 14 as will be described in more detail below, and is pumped past motor section 14 to outlet section 16 where the fuel exits fuel pump 10 through an outlet 19 of outlet section 16.

Motor section 14 includes an electric motor 20 which is disposed within housing 18. Electric motor 20 includes a shaft 22 extending therefrom into pump section 12. Shaft 22 rotates about a first axis 24 when an electric current is applied to electric motor 20. Electric motors and their operation are well known, consequently, electric motor 20 will not be discussed further herein.

With continued reference to FIG. 1 and now with additional reference to FIGS. 2-6, pump section 12 includes an inlet plate 26, a pumping arrangement, and an outlet plate 32. The pumping arrangement includes a rotating element that is illustrated as an inner gear rotor 28. The pumping arrangement is also illustrated as including an outer gear rotor 30. Collectively, inner gear rotor 28 and outer gear rotor 30 will be referred to herein as pumping arrangement 28, 30. Inlet plate 26 is disposed at the end of pump section 12 that is distal from motor section 14 while outlet plate 32 is disposed at the end of pump section 12 that is proximal to motor section 14. Pumping arrangement 28, 30 is rotatably disposed within a gear rotor bore 34 which extends into outlet plate 32 from the face of outlet plate 32 that abuts inlet plate 26. Gear rotor bore 34 is centered about a second axis 36 (best shown in FIG. 4) which is parallel and laterally offset relative to first axis 24. In this way, pumping arrangement 28, 30 is located axially between inlet plate 26 and outlet plate 32 such that inlet plate 26 interfaces with pumping arrangement 28, 30 in an inlet sealing surface interface 38 and such that outlet plate 32 interfaces with pumping arrangement 28, 30 in an outlet sealing surface interface 40. Gear rotor bore 34 is diametrically sized to allow outer gear rotor 30 to rotate freely therein while substantially preventing radial movement of outer gear rotor 30. Gear rotor bore 34 is axially sized, i.e. in the direction of second axis 36, to be slightly larger than the thickness of pumping arrangement 28, 30 in order to allow inner gear rotor 28 and outer gear rotor 30 to rotate freely therein while keeping the clearance at inlet sealing surface interface 38 and outlet sealing surface interface 40 sufficiently small to allow the fluid to be pressurized by rotation of pumping arrangement 28, 30. By way of non-limiting example only, the axial clearance at each of inlet sealing surface interface 38 and outlet sealing surface interface 40 may be 10 μm, for a total of 20 μm axial clearance provided for pumping arrangement 28, 30 within gear rotor bore 34. Inlet plate 26 includes an inlet 42 which extends therethrough to provide fluid communication from the outside of fuel pump 10 to gear rotor bore 34 while outlet plate 32 includes an outlet plate outlet passage 44 which extends therethrough to provide fluid communication from gear rotor bore 34 to outlet section 16.

Inner gear rotor 28 includes a plurality of external teeth 46 on the outer perimeter thereof which engage complementary internal tooth recesses 48 of outer gear rotor 30, thereby defining a plurality of variable volume pumping chambers 50 between inner gear rotor 28 and outer gear rotor 30. It should be noted that only representative external teeth 46, internal tooth recesses 48 and pumping chambers 50 have been labeled in the drawings. As shown, inner gear rotor 28 has eight external teeth 46 while outer gear rotor 30 has nine internal tooth recesses 48; however, it should be understood that inner gear rotor 28 may have any number n external teeth 46 while outer gear rotor 30 has n+1 internal tooth recesses 48. Inlet 42 of inlet plate 26 is aligned with a portion of gear rotor bore 34 within which the geometry between external teeth 46 and internal tooth recesses 48 create pumping chambers 50 of relative large size while outlet plate outlet passage 44 of outlet plate 32 is aligned with a portion of gear rotor bore 34 within which the geometry between external teeth 46 and internal tooth recesses 48 create pumping chambers 50 of relatively small size. A sleeve 52 is disposed in an outlet plate bore 32*a* of outlet plate 32. Shaft 22 extends the sleeve 52 such that sleeve 52 and shaft 22 form a bearing interface which allows shaft 22 to rotate freely about first axis 24 while preventing movement of shaft 22 in a lateral direction relative to first axis 24. Inner gear rotor 28 may also include a notch 29 in which an end of sleeve 52 is disposed. In alternative embodiments not shown, shaft 22 may extend through the outlet plate bore 32*a* of outlet plate 32 such that outlet plate bore 32*a* and shaft 22 form the bearing interface, i.e. the sleeve 52 may not be present. Inner gear rotor 28 is rotationally coupled to shaft 22 as described in more detail below, and consequently, when electric motor 20 is rotated by application of an electric current, inner gear rotor 28 rotates about first axis 24. By virtue of external teeth 46 engaging internal tooth recesses 48, rotation of inner gear rotor 28 causes outer gear rotor 30 to rotate about second axis 36. In this way, the volume of pumping chambers 50 decreases as each pumping chamber 50 rotates from being in communication with inlet 42 to being in communication with outlet plate outlet passage 44, thereby causing fuel to be pressurized and pumped from inlet 42 to outlet plate outlet passage 44. The fuel is then communicated past the electric motor 20 to outlet 19.

Figure 6:
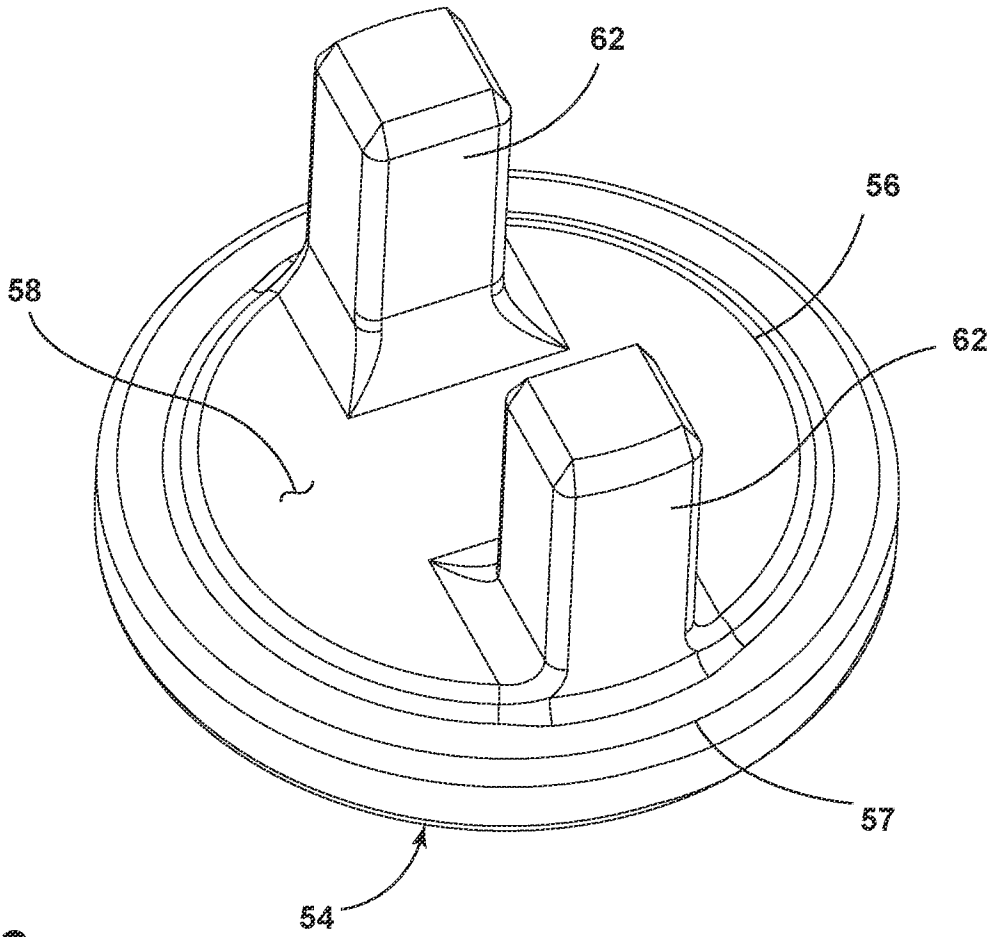
FIG. 6 is a perspective view of the thrust bearing driver of the internal portion of the pumping section of FIG. 3.
Figure 7:
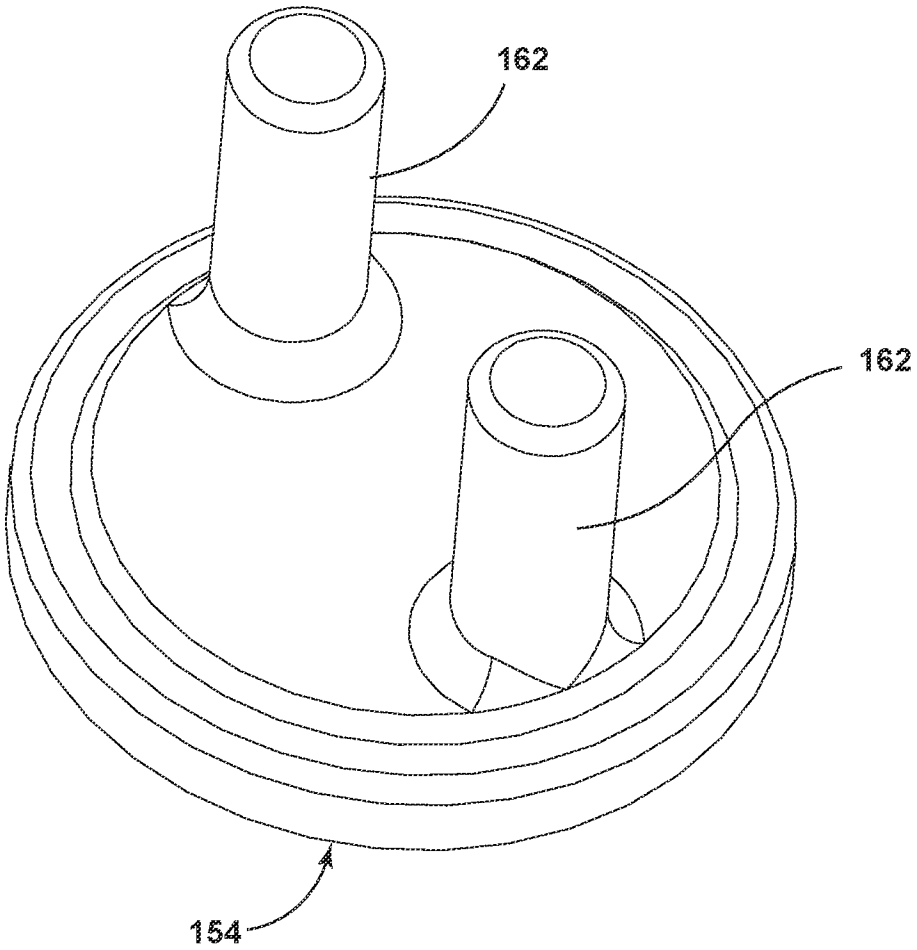
FIG. 7 is a perspective view of a thrust bearing driver in accordance with some embodiments of the disclosure.
Figure 8:
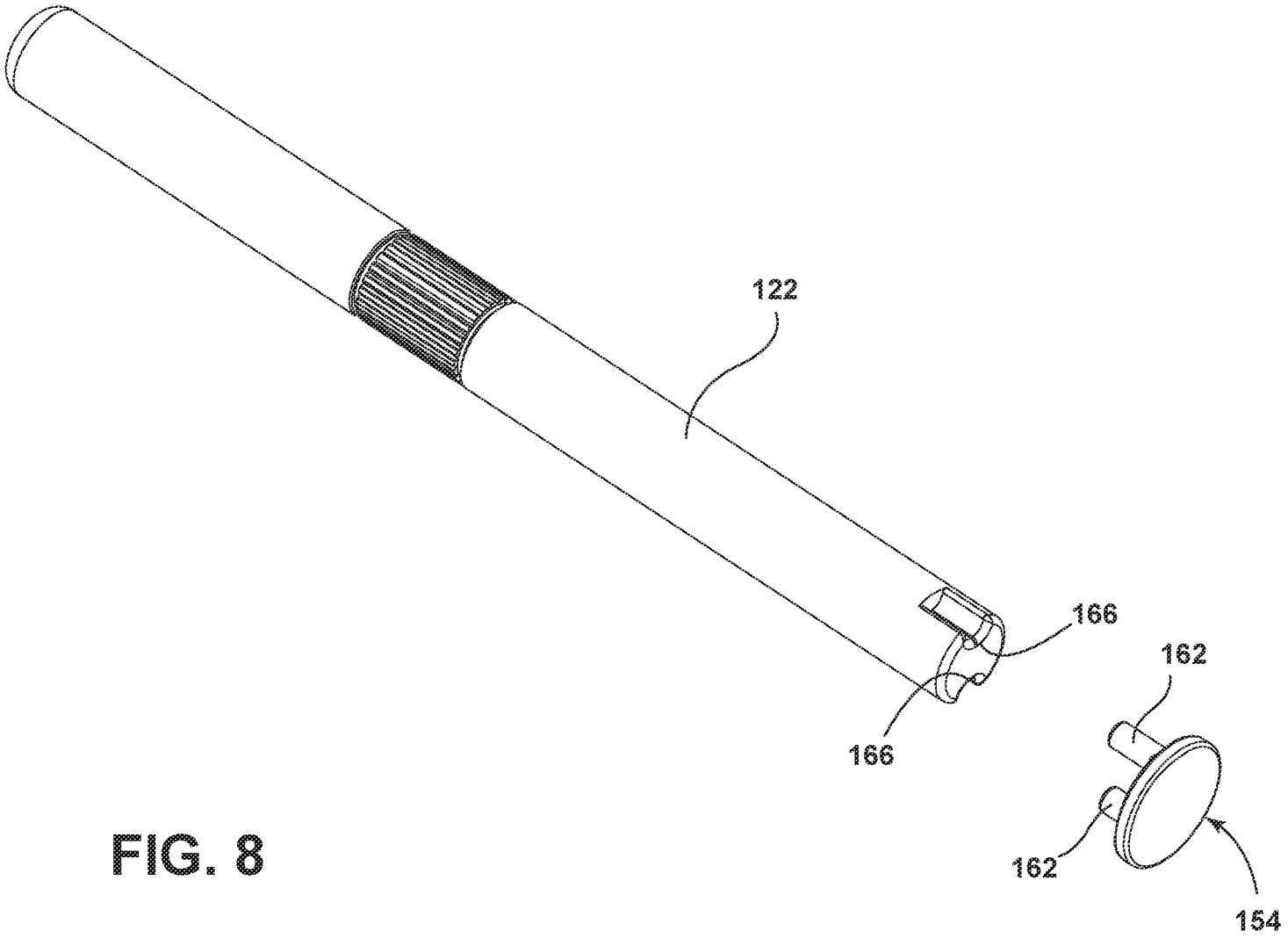
FIG. 8 is a perspective view of the thrust bearing driver of FIG. 7 and a shaft in accordance with some embodiments of the disclosure.

A thrust bearing driver 54 couples shaft 22 to inner gear rotor 28. Thrust bearing driver 54 includes a disc-like plate 56 having a first face 58 and a second face 60. Two projections in the form of pins, prongs, or posts 62 extend generally perpendicularly from first face 58. Posts 62 are generally elongated and have a length in an axial direction (direction of first axis 24) that is much larger than the thickness of plate 56 in the axial direction. As shown in FIG. 6, posts 62 are also generally cuboid/prismoid/prismatic in shape (such as a generally rectangular prism) with a generally parallelogram cross-section (e.g., square, rectangular), although the posts are not limited to this shape and may be, for example, cylindrical in shape or have any of various polygonal shapes. For example, as shown in FIG. 7, the posts 162 of a thrust bearing driver 154 may be cylindrical and have a circular cross-sectional shape. Alternatively, as shown in FIG. 8, the posts 262 of a thrust bearing driver 254 may have a "half-rounded" shape in which the outer half of the post 262 is cylindrical (with a semi-circular cross-section) and has a rounded/curved surface, while the inner half of the post 262 is polygonal (square, rectangle, etc.) and has generally flat surfaces (with a square or rectangular cross-sectional shape). Additionally, while the posts 62 may have a generally square or rectangular cross-section, the corners/edges of the post may be beveled or rounded, and is within the scope of the embodiments disclosed herein.

Figure 9:
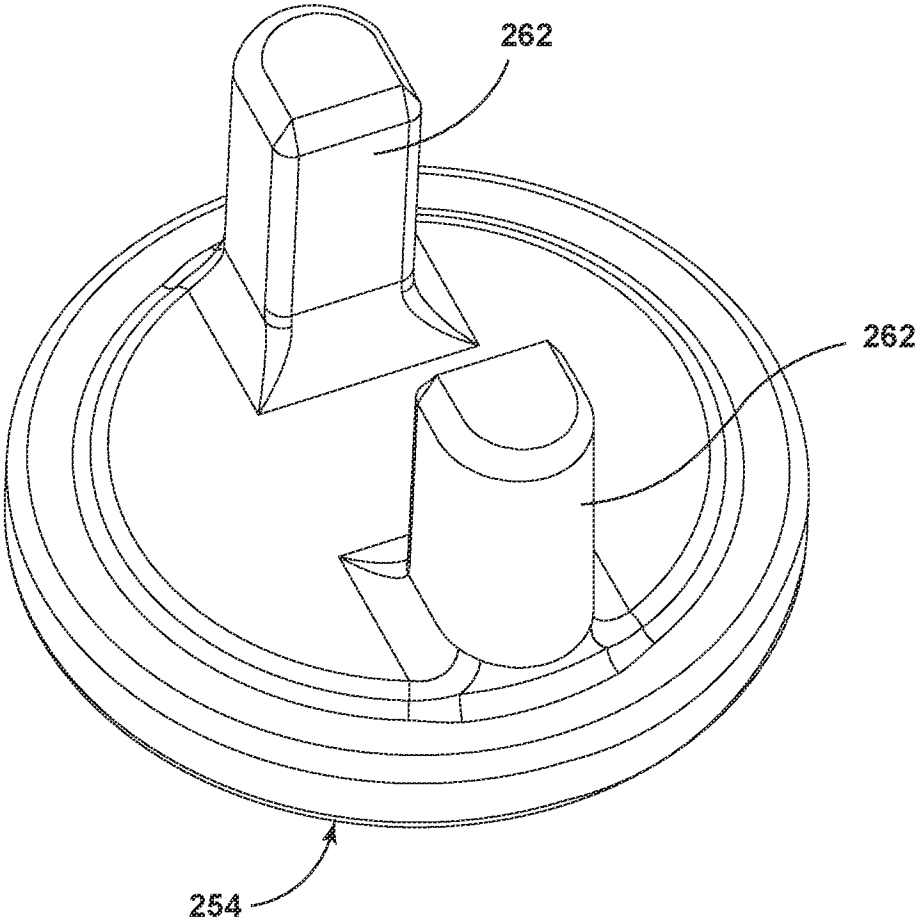
FIG. 9 is a perspective view of a thrust bearing driver in accordance with some embodiments of the disclosure.

The posts 62 are symmetrically disposed on the first face 58 such that the posts 62 are an equal distance from the center of face 58. The posts 62 are also disposed proximate an outer edge 57 of the plate 56. Shaft 22 has a terminal end 64 opposite motor 20 that includes a pair of slots 66 radially disposed on the side surface 68 of the shaft 22, the slots 66 being formed as depressions in the side surface 68. Slots 66 are arranged 180 degrees from each other in a radial direction around surface 68, extend axially from terminal end 64 towards motor 20, and are in the form of an elongated curved groove. The slots 66 of shaft 22 have a shape that complement (are sized and shaped) to receive and mate with the posts 62 of thrust bearing driver 54. For example, as shown best in FIG. 3, the slots 66 have flat sides and a generally rectangular shape to receive the posts 62 of the thrust bearing driver 54. Alternatively, as shown in FIG. 8, in embodiments in which the cylindrical shaped posts 162 having a circular (or semi-circular) cross-section, the slots 166 of the shaft 122 have a semicircular cross-section and are generally rounded to receive the cylindrical shaped posts 162. The terminal end 64 of shaft 22 is disposed between the two posts 62, and when posts 62 are received in slots 66, the terminal end 64 contacts and engages first face 58 of thrust bearing driver 54. Similarly, inner gear rotor 28 has an inner circular/cylindrical surface 70 that includes a pair of slots 72 radially disposed on surface 70 of the inner gear. The inner surface 70 of inner gear rotor 28 defines a void space in the center of the inner gear rotor 28 through which the shaft 22 is disposed. Slots 72 are arranged 180 degrees from each other in a radial direction around surface 70, extend axially from a side 74 of inner gear rotor 28, and are in the form of an elongated curved groove. The slots 72 also may not extend all the way from side 74 of the inner gear rotor 28 to the opposite side 76. The slots 72 of inner gear rotor 28 have a shape that complements (is sized and shaped) to receive and mate with the posts 62 of thrust bearing driver 54. Particularly, when the posts 62 of thrust bearing driver 54 are received in slots 72, the shaft 22 is coupled to the inner gear rotor 28, the side 74 of the inner gear rotor 28 faces an inner surface 27 of inlet plate 26, and the second face 60 of the thrust bearing driver 54 engages the inner surface 27. In this arrangement, thrust bearing driver 54 is sandwiched between shaft 22 and inlet plate 26 in an axial direction (in the direction of first axis 24), and is sandwiched between shaft 22 and inner gear rotor 28 in a radial direction (in a direction extending outwardly from and perpendicular to the first axis 24). In the alternative embodiments of the thrust bearing driver 254 shown in FIG. 9, the thrust bearing driver 254 has a polygonal inner half having flat sides that mate with a shaft having slots with flat sides, while the thrust bearing driver 254 has a rounded outer half that mates with rounded slots on the inner gear rotor 28.

In operation, electricity is applied to electric motor 20 which causes pumping arrangement 28, 30 to rotate via rotating of shaft 22, thereby drawing fuel in through inlet 42 to pumping chambers 50 at an initial pressure which may be by way of non-limiting example only, 0 kPa. Rotation of pumping arrangement 28, 30 further causes the volume of pumping chambers 50 to decrease as each pumping chamber 50 rotates from being in communication with inlet 42 to being in communication with outlet plate outlet passage 44, thereby causing fuel to be pressurized to a final pressure which may be by way of non-limiting example only, on the order of 400 kPa, and pumped from inlet 42 to outlet plate outlet passage 44 to high pressure chamber #located downstream of outlet plate outlet passage 44 within housing 18. The fuel is communicated past electric motor 20 to outlet 19. The thrust bearing driver 54 transfers torque from the shaft 22 to the pumping arrangement 28, 30, and balances the load prevent against radial side loading to keep the inner gear rotor 28 centered. The thrust bearing driver 54 also provides a bearing surface between the shaft 22 and the inlet plate 26 to reduce or eliminate noise and wear that typically exists with direct shaft to inlet plate surface arrangements. Further, the thrust bearing driver 54 provides angular and radial alignment of the shaft 22, the inner gear rotor 28, and the inlet plate inner surface 27 to prevent against misalignment of the shaft 22 to the inlet plate 26 and to ensure contact of the thrust bearing driver 54 with the inlet plate surface 27. Moreover, the thrust bearing driver 54 provides a dual pin/key engagement of the shaft 22 and inner gear rotor 28 that adds durability to the drive of the fuel pump 10.

While the thrust bearing driver 54, 154, 254 has been described by example as being included in a gerotor-type fluid pump, the thrust bearing driver may be utilized in other types of fluid pumps such as impeller-type or vane-type pumps, such that the rotating element of the pumping arrangement may take other forms which may include, by way of non-limiting example, an impeller. The thrust bearing driver 54, 154, 254 may be applied to any device in which a rotating shaft transfers rotational load and movement to a mechanism. The thrust bearing driver 54, 154, 254 transfers torque from the shaft of a rotating source to a coupled mechanism (loads tangential to the shaft), and absorbs any axial load that is acting on the shaft, such as, for example, loads generated by gravity, a spring that is in line with the shaft axis, or as in the illustrated embodiment above, the axial load of the magnetic field acting on the motor rotor shaft 22.

It is to be understood that the appended claims are not limited to express and particular compounds, compositions, or methods described in the detailed description, which may vary between particular embodiments which fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

What is claimed is:

1. A fluid pump comprising:

a housing;

an inlet plate disposed within the housing, the inlet plate having an inlet which introduces fluid to the housing;

an outlet plate disposed within the housing, the outlet plate having an outlet passage;

an outlet which discharges fluid from the housing;

the inlet, outlet passage, and outlet being in fluid communication with each other;

an electric motor disposed with the housing between the outlet plate and the outlet, the electric motor having a shaft that rotates about an axis;

a pumping arrangement rotationally coupled to the shaft such that rotation of the pumping arrangement by the shaft causes fluid to be pumped from the inlet to the outlet passage and through the outlet, the pumping arrangement being located axially between the inlet plate and the outlet plate, and the pumping arrangement including a rotating element; and a thrust bearing driver including a disc-like plate having first and second faces, and two posts extending perpendicularly from the first face;

the shaft having a terminal end including a pair of slots that cooperate with the posts of the thrust bearing driver;

the rotating element having an inner surface including a pair of slots that cooperate with the posts of the thrust bearing driver;

wherein the posts of the thrust bearing driver are received in the slots of both the shaft and the rotating element, and the thrust bearing driver is sandwiched between the shaft, the inlet plate, and the rotating element.

2. The fluid pump of claim 1, wherein the posts of the thrust bearing driver have a polygonal cross-sectional shape.

3. The fluid pump of claim 2, wherein the slots of the shaft have a shape that complements the cross-sectional shape of the posts of the thrust bearing driver.

4. The fluid pump of claim 2, wherein the slots of the rotating element have a shape that complements the cross-sectional shape of the posts of the thrust bearing driver.

5. The fluid pump of claim 1, wherein the posts of the thrust bearing driver have a circular cross-sectional shape.

6. The fluid pump of claim 5, wherein the slots of the shaft have a shape that complements the cross-sectional shape of the posts of the thrust bearing driver.

7. The fluid pump of claim 5, wherein the slots of the rotating element have a shape that complements the cross-sectional shape of the posts of the thrust bearing driver.

8. The fluid pump of claim 1, wherein the posts of the thrust bearing driver have an outer portion that includes a rounded surface and an inner portion that includes a flat surface.

9. The fluid pump of claim 8, wherein the slots of the shaft have a shape that complements the flat surface of the posts of the thrust bearing driver.

10. The fluid pump of claim 8, wherein the slots of the rotating element have a shape that complements the rounded surface of the posts of the thrust bearing driver.

11. The fluid pump of claim 1, wherein the posts of the thrust bearing driver are symmetrically arranged on the first face of the plate.

12. The fluid pump of claim 1, wherein the posts of the thrust bearing driver are arranged proximate an outer edge of the plate.

13. The fluid pump of claim 1, wherein the terminal end of the shaft engages the first face of the plate.

14. The fluid pump of claim 1, wherein the second face of the plate engages a surface of the inlet plate.

15. The fluid pump of claim 1, wherein the slots of the thrust bearing driver mate with the slots of the shaft and the slots of the rotating element to couple the shaft to the rotating element.

16. The fluid pump of claim 1, wherein the thrust bearing driver is sandwiched between the shaft and the inlet plate in an axial direction, and the thrust bearing driver is sandwiched between the shaft and the rotating element in a radial direction.

17. The fluid pump of claim 1, wherein the rotating element is an inner gear rotor that together with an outer gear rotor form the pumping arrangement.

* * * * *